US012245641B1

(12) United States Patent
Amar

(10) Patent No.: US 12,245,641 B1
(45) Date of Patent: Mar. 11, 2025

(54) ELECTRONIC VAPORIZING DEVICE HAVING A FLEXIBLE MOUTHPIECE

(71) Applicant: Victor Amar, New York, NY (US)

(72) Inventor: Victor Amar, New York, NY (US)

( * ) Notice: Subject to any disclaimer, the term of this patent is extended or adjusted under 35 U.S.C. 154(b) by 0 days.

(21) Appl. No.: 18/358,306

(22) Filed: Jul. 25, 2023

Related U.S. Application Data

(60) Provisional application No. 63/499,535, filed on May 2, 2023.

(51) Int. Cl.
*A24F 7/00* (2006.01)
*A24F 40/40* (2020.01)
*A24F 40/10* (2020.01)

(52) U.S. Cl.
CPC ..... *A24F 7/00* (2013.01); *A24F 40/40* (2020.01); *A24F 40/10* (2020.01)

(58) Field of Classification Search
CPC .. A24F 7/00; A24F 40/40; A24F 40/42; A24F 40/10
See application file for complete search history.

(56) References Cited

U.S. PATENT DOCUMENTS

| | | | | |
|---|---|---|---|---|
| 9,402,422 | B2 * | 8/2016 | Shenkal | H05B 3/40 |
| 10,021,905 | B1 * | 7/2018 | Bebee | F04B 39/123 |
| 10,517,334 | B1 * | 12/2019 | Volodarsky | A24D 3/17 |
| D875,302 | S | 2/2020 | Pan | |
| D875,305 | S | 2/2020 | Lai | |
| 10,617,148 | B2 * | 4/2020 | Shenkal | A61M 15/06 |
| D889,736 | S | 6/2020 | Han | |
| 11,000,067 | B1 * | 5/2021 | Bajpai | H02J 50/005 |
| D1,002,098 | S | 10/2023 | Wei et al. | |
| D1,002,925 | S | 10/2023 | Huang et al. | |
| D1,013,258 | S | 1/2024 | Huang et al. | |
| 11,910,826 | B2 | 2/2024 | Blackmon et al. | |
| 11,957,834 | B2 | 4/2024 | Feng | |
| 2015/0150305 | A1 * | 6/2015 | Shenkal | A24F 40/485 131/329 |
| 2015/0157053 | A1 * | 6/2015 | Mayor | A24F 40/485 131/329 |

(Continued)

FOREIGN PATENT DOCUMENTS

| | | | | |
|---|---|---|---|---|
| CA | 3098251 | A1 * | 10/2019 | A24F 40/10 |
| CA | 222464 | | 7/2023 | |

(Continued)

OTHER PUBLICATIONS

No author name readily ascertainable. Make it elf, enjoy yourself—ELFBAR. Retrieved from the Internet <URL: https://www.elfbar.com>. Available since Feb. 21, 2023 or prior.

(Continued)

*Primary Examiner* — Hae Moon Hyeon
(74) *Attorney, Agent, or Firm* — Gottlieb, Rackman & Reisman, PC

(57) ABSTRACT

A vaporing device that includes a body portion and a mouthpiece connected to the body portion. The mouthpiece is made of a flexible, elastomeric material in order to prevent injury to a user of the vaporizing device and to extend the usable life of the vaporizing device. Due to the flexibility and shape of the mouthpiece, the mouthpiece can be compressed with varying degrees of force to allow the mouthpiece to provide a satisfactory feel without causing damage to the mouthpiece of user's teeth.

10 Claims, 4 Drawing Sheets

(56) References Cited

U.S. PATENT DOCUMENTS

| | | | | |
|---|---|---|---|---|
| 2016/0270446 | A1* | 9/2016 | Shenkal | H05B 3/40 |
| 2016/0375206 | A1* | 12/2016 | Gramann | A61M 15/0021 128/203.12 |
| 2018/0110259 | A1* | 4/2018 | Kartashov | A24F 1/22 |
| 2019/0111219 | A1 | 4/2019 | Campos | |
| 2021/0127736 | A1* | 5/2021 | Grimm | A24D 3/17 |
| 2022/0104553 | A1* | 4/2022 | Bajpai | A24F 40/90 |
| 2022/0132926 | A1* | 5/2022 | Qiu | A24F 40/42 131/329 |
| 2022/0225669 | A1 | 7/2022 | Hawes et al. | |
| 2022/0279843 | A1* | 9/2022 | Bessant | A24F 40/40 |
| 2022/0312851 | A1* | 10/2022 | Batista | H05B 6/108 |
| 2022/0400761 | A1 | 12/2022 | Tang et al. | |
| 2023/0110108 | A1* | 4/2023 | Qiu | A24F 7/02 131/329 |

FOREIGN PATENT DOCUMENTS

| | | | | |
|---|---|---|---|---|
| CN | 202230687961.X | | 1/2023 | |
| CN | 202330050099.6 | | 4/2023 | |
| CN | 202330178489.1 | | 9/2023 | |
| CN | 202330178551.7 | | 9/2023 | |
| CN | 702023030178613 | | 9/2023 | |
| EM | 015009280-0003 | | 3/2023 | |
| KR | 3011131190000 | | 6/2021 | |
| WO | WO-2018198093 | A2 * | 11/2018 | A24F 40/10 |
| WO | D222876-0001 | | 8/2022 | |
| WO | D224682-0001 | | 10/2022 | |
| WO | D226059-0010 | | 1/2023 | |

OTHER PUBLICATIONS

No author name readily ascertainable. Home—fume vape. Retrieved from the Internet <URL: https://fumevape.com>. Available since Feb. 21, 2023 or prior. INNOKIN—A Leading Global Vape Brand & Manufacturer. Retrieved from the Available since Feb. 21, 2023 or prior.

No author name readily ascertainable. Internet <URL: https://www.innokin.com>.

VUSE Pro Device Kit, https://www.vuse.ie/products/vuse-pro-device-kit, P.J. Carroll & Company Limited. Suite D, 2nd Floor, The Apex Building, Blackthorn Road, Sandyford Industrial Estate, Dublin, retreived Mar. 28, 2024.

Bluehole Publishes an Industry Comment on Vuse Overtaking Juul and Becoming the U.S Vaping Market Champion Again, https://www.businesswire.com/news/home/20220512005478/en/Bluehole-Publishes-an-Industry-Comment-on-Vuse-Overtaking-Juul-and-Becoming-the-U.S-Vaping-Market-Champion-Again, May 12, 2022.

* cited by examiner

ELECTRONIC VAPORIZING DEVICE HAVING A FLEXIBLE MOUTHPIECE

CROSS-REFERENCE TO RELATED APPLICATION

This application claims priority under 35 U.S.C. § 119 to U.S. Provisional Patent Application No. 63/499,535, filed on May 2, 2023 in the U.S.P.T.O., the disclosure of which is incorporated by reference herein in its entirety.

TECHNICAL FIELD

The present invention relates to an electronic vaporizing device, and more particularly, to an electronic vaporizing device having an elastomeric delivery mouthpiece.

DISCUSSION OF THE RELATED ART

Electronic vaporizing (or "vaping") devices are well-know. The basic operating principle of a vape includes transmitting electrical power to a heating element (such as a coiled wire) in order to generate heat. The heat generated by the heating element, which is in contact with a vaping liquid, causes the vaping liquid to become atomized (e.g., to become vapor). A user of the vaping device inhales the vapor.

Vaping devices are generally equipped with rigid mouthpieces. By virtue of their rigidity, the mouthpieces have numerous disadvantages, including causing harm to a user's teeth during a vaping session. This is because users of vaping devices generally tend to bite the part of the mouthpiece that is inserted their mouth during vaping.

In addition, the biting force that is delivered to a rigid mouthpiece during use can cause the mouthpiece to crack or break. This is undesirable because the crack or breakage in the mouthpiece can expose a user to the vaping liquid that is stored inside of the device. For example, the vaping liquid can leak into the user's mouth via the crack or breakage while vaping. This would expose the user to vape in liquid form as opposed to the intended atomized form thereof, which is undesirable.

Furthermore, a crack or break in the mouthpiece can significantly reduce the usable life of a vaping device by allowing the vaping liquid stored inside of the device to evaporate in ambient air.

SUMMARY

A vaping device of the present invention includes a mouthpiece made of a flexible polymeric material. The flexibility of the mouthpiece is advantageous because it prevents harm/injury to a user while simultaneously extending the usable life of the vaping device.

BRIEF DESCRIPTION OF THE DRAWINGS

The above and other features of the present invention will become more apparent by describing in detail exemplary embodiments thereof in conjunction with the accompanying drawings, in which.

DETAILED DESCRIPTION OF THE EMBODIMENTS

Figure 1:
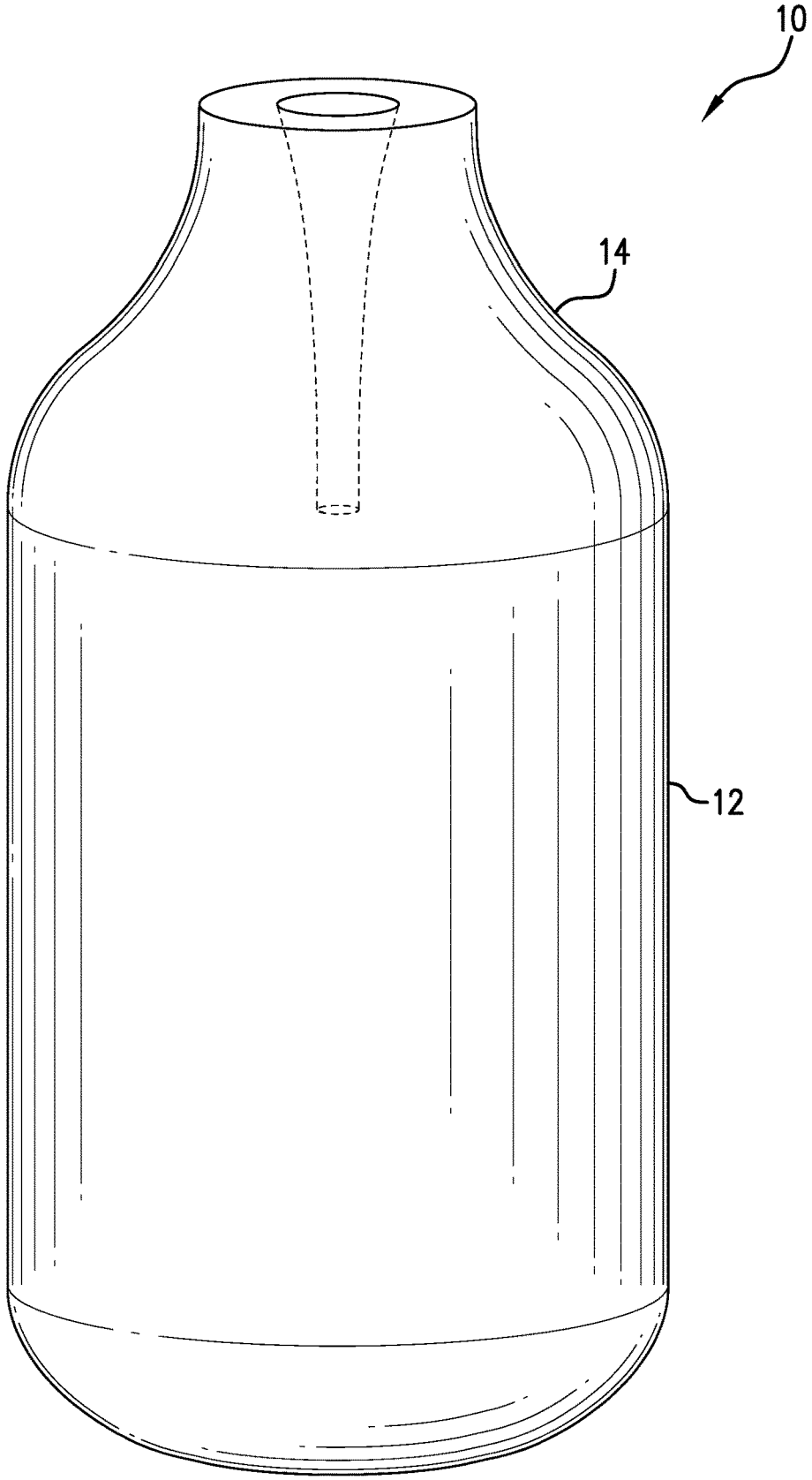
FIG. 1 is a perspective view illustrating a vaping device according to an embodiment of the present invention.
Figure 2:
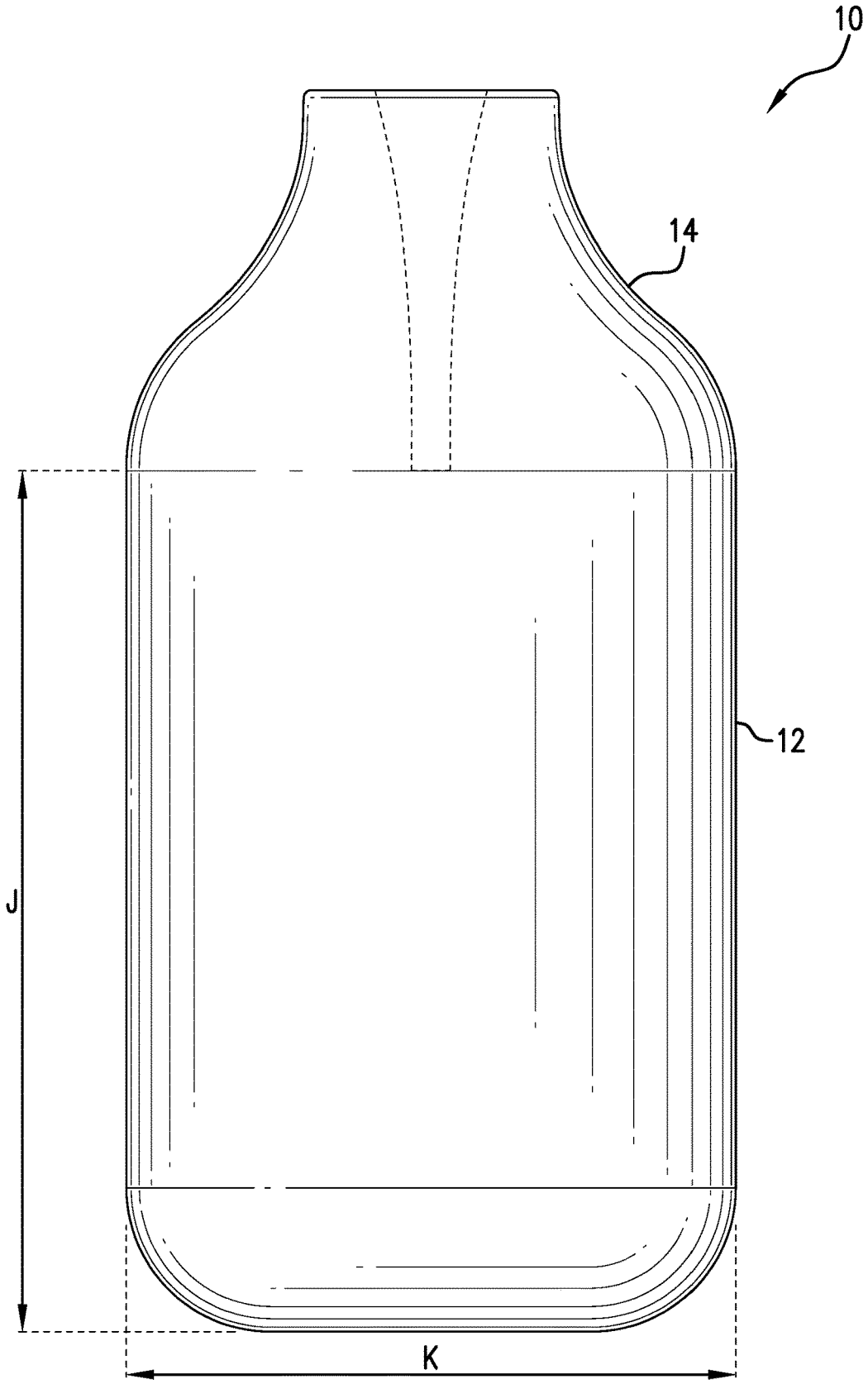
FIG. 2 is a front view illustrating the vaping device of FIG. 1.

Exemplary embodiments of the present invention will be described more fully hereinafter with reference to the accompanying drawings. The present invention may, however, be embodied in different forms and should not be construed as being limited to the embodiments set forth herein. Like reference numerals may refer to like elements throughout the specification. The sizes and/or proportions of the elements illustrated in the drawings may be exaggerated for clarity. The dimensions illustrated in the drawing and referenced below are merely exemplary, and do not limit the present invention thereto.

FIGS. 1-5 illustrate a vaping device 10 according to exemplary embodiment of the present invention.

Referring to FIG. 1, the vaping device 10 includes a body portion 12 and a mouthpiece 14 coupled to the body portion 12. The body portion 12 may include a tank storing a vaporizing liquid inside, a vaporizer assembly for vaporizing the liquid stored in the tank, and a power source (e.g., a battery) for supplying electrical power to the vaporizer assembly.

The power source may be a rechargeable battery. In this case, the body portion 12 may be provided with an interface for charging the battery. The interface may include, for example, a universal serial bus (USB) port or other type of electrical charging port for transmitting electrical power to the battery.

The mouthpiece 14 is made of an elastomeric material. This is particularly important because the flexing property of the elastomeric material that makes up the mouthpiece 14 can substantially prevent damage to a user's teeth (such as chipping or breaking) that can occur when biting a rigid, hard, or otherwise substantially non-deformable mouthpiece.

In addition, the flexible nature of the elastomeric material that makes up the mouthpiece 14 and the structural configuration (e.g., three-dimensional shape) of the mouthpiece 14 enable the mouthpiece 14 to withstand biting action from a user without cracking or breaking (e.g., without suffering structural damage). That is, the elasticity of the material that makes up the mouthpiece 14 causes the mouthpiece 14 to flexibly deform when bitten by a user as opposed to cracking or breaking. Said elastic property is also advantageous because it enables the mouthpiece 14 to revert to its original shape after being bitten.

Due to its flexibility and shape, the mouthpiece 14 can be compressed to different degrees in response to different amounts of biting force. For example, a normal bite into the mouthpiece 14 can cause the mouthpiece 14 to be squeezed by a certain amount. A strong bite into the mouthpiece 14 can cause it to be squeezed by a greater amount than that of the normal bite. A user would be able to perceive the "give" or squeeze in the mouthpiece 14 when biting. Therefore, the mouthpiece 14 would enable a user to bite it with a desired level of force in order to provide the user with a satisfactory mouthfeel without causing damage to the user's teeth or to the mouthpiece 14.

Furthermore, the elasticity and structural configuration of the mouthpiece 14 is important because, by resisting biting action without cracking or breaking, the mouthpiece 14 can also prevent exposing a user to vape in liquid form. For example, cracks or breaks in the structure of a conventional rigid mouthpiece can cause the vaping liquid to leak from the inside of the vaping device into a user's mouth during vaping. The present invention virtually forecloses this undesirable scenario because the mouthpiece 14 is virtually unbreakable/un-crackable.

In addition, and since the mouthpiece 14 is very resistant to cracking or breaking, the mouthpiece 14 can greatly extend the usable life of the vaping device 10. This is because conventional vaping devices that develop a crack or breakage in the mouthpiece would typically allow the vaping liquid that is stored inside of the device to evaporate in ambient air through the crack. This, in turn, reduces the amount of liquid vape that is available for use inside of the tank, and therefore, reduces the usable life of the conventional vaping device. The mouthpiece 14 of the present invention virtually eliminates this concern because it is substantially unbreakable, and therefore, not prone to developing cracks or breakage points that would otherwise allow liquid vape from the storage tank to evaporate into the environment.

The mouthpiece 14 can be made of, for example, silicone (e.g., food grade silicone), latex (e.g., food grade latex), etc.

The silicone that is used for making the mouthpiece 14, in an embodiment, is a blend of materials. In this embodiment, the mouthpiece 14 is made of a blend containing 15-35% silicon dioxide by weight, 5-10% silicone oil by weight, and 60-80% methyl vinyl silicone rubber by weight. The material that results from this blend has a hardness of about 40 Shore, a tensile failure stress point that ranges from about 0 to about 90 Shore, and a compressive failure stress point of about 20 MPa. In addition, the material resulting from this blend is believed to be operational between −50° C. and 200° C. The mechanical properties of the blend of 15-35% silicon dioxide, 5-10% silicone oil, and 60-80% methyl vinyl silicone rubber enable the mouthpiece 14 to satisfy a user's urge to bite the mouthpiece 14 without damaging the mouthpiece 14 and without damaging the user's teeth. In addition, the level of flexibility in the mouthpiece 14 that results from making the mouthpiece 14 from this blend of materials together with the shape of the mouthpiece 14 provides just the right amount of mouthfeel to a user when biting (i.e., it is not too soft and not too hard, just like the user may desire).

Figure 3:
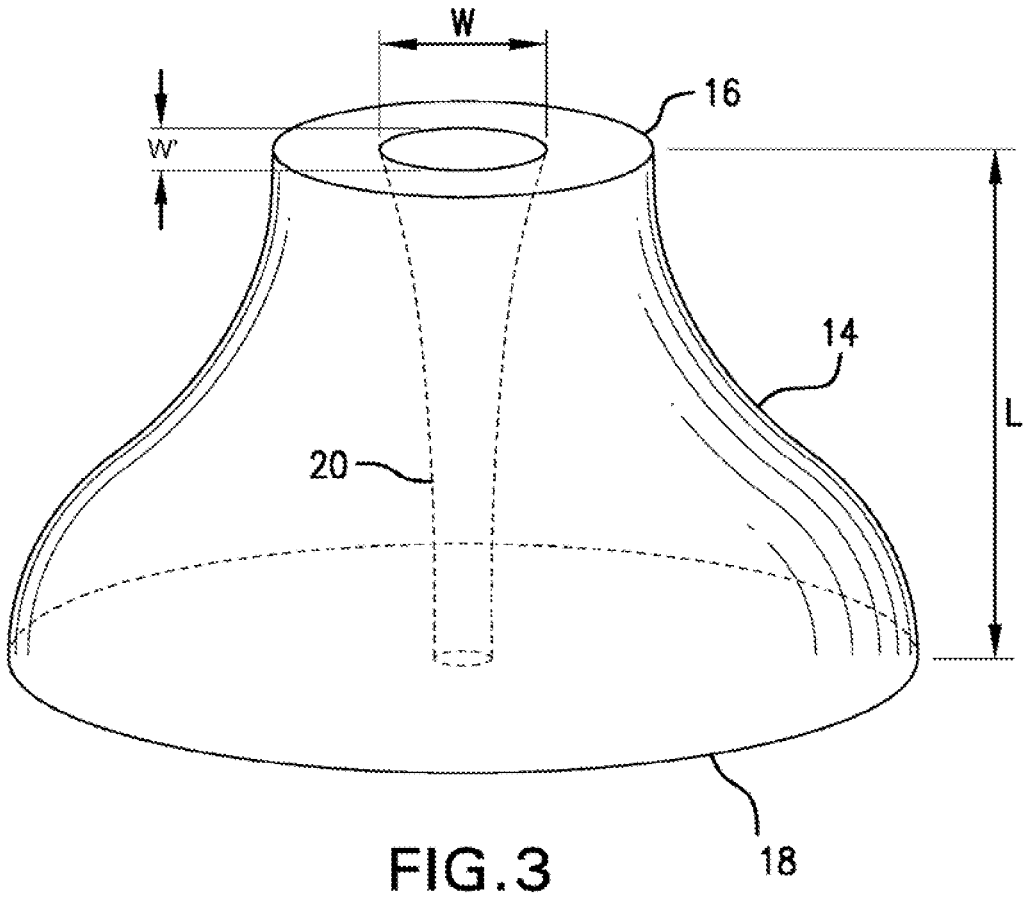
FIG. 3 is a perspective view illustrating a mouthpiece of the device of FIG. 1.
Figure 4:
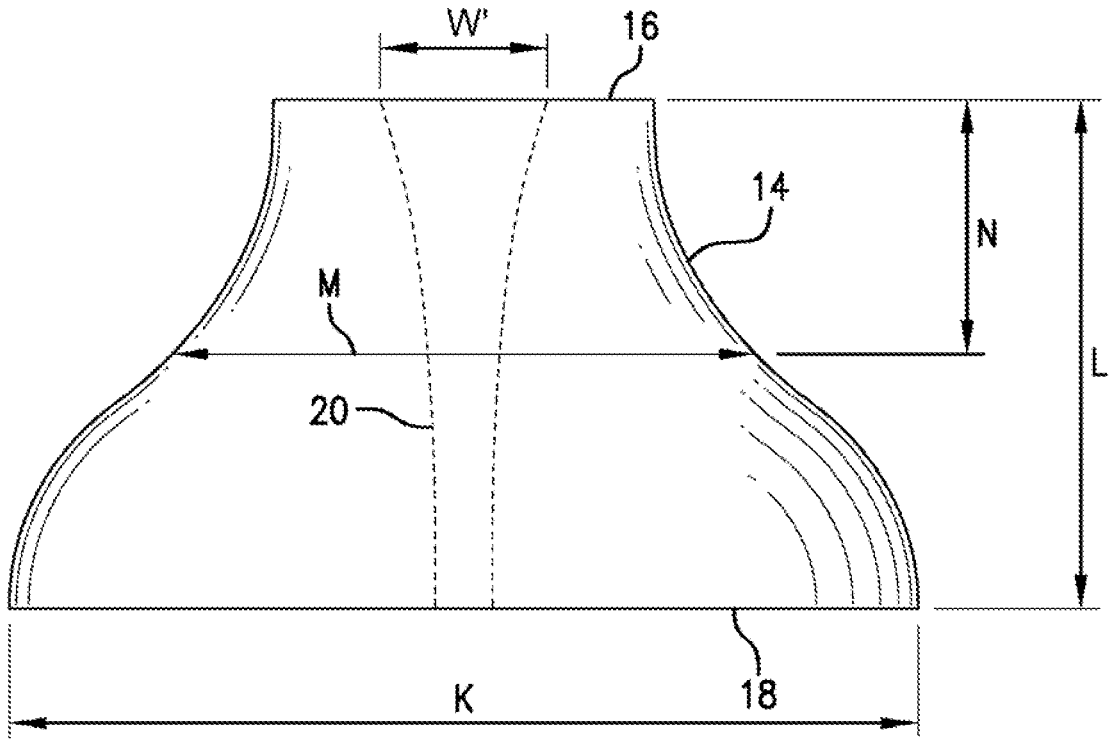
FIG. 4 is a front view illustrating the mouthpiece of FIG. 3.
Figure 5:
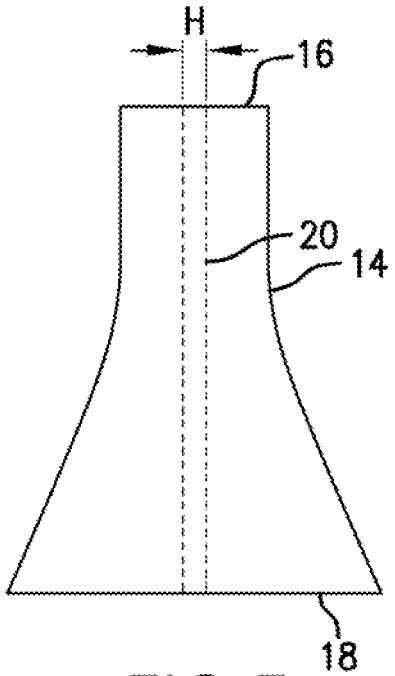
FIG. 5 is a side view illustrating the mouthpiece of FIG. 3.

FIGS. 3-5 illustrate the mouthpiece 14 in isolation from the body portion 12 of the vaping device 10 for convenience purposes.

Referring to FIGS. 3-5, the mouthpiece 14 has a body with a first end 16 (configured to be placed into the oral cavity of a user), a second end 18 opposite to the first end 16 (the second end 18 is configured to be attached to the device 10), and an opening 20 extending through the body between the first and second ends 16 and 18 thereof. In other words, the mouthpiece 14 is hollow.

As illustrated in FIGS. 3-4, the body of the mouthpiece 14 has a length L measured in a direction extending between the first and second ends 16 and 18 thereof. The length L, in an embodiment, is about 19 mm. The first end 16 of the body of the mouthpiece 14 may have a generally oblong shape. The second end 18 may also have a generally oblong shape, greater in size than that of the first end 16. As illustrated in FIGS. 3-5, the first and second ends 16 and 18 of the mouthpiece 14 may define substantially flat surfaces.

In addition, the second end 18 may be configured to match a shape of the body portion 12 of the vaping device 10 in order to provide a seamless and fluid transition between the body portion 12 and the mouthpiece 14. However, it is understood that the second end 18 of the body of the mouthpiece of can have any desirable shape. In addition, and regardless of the shape of the mouthpiece 14 (including the shape of the second end 18), the interface between the second end 18 of the body of the mouthpiece 14 and the vaporizer assembly inside of the body portion 12 must be sealed/airtight such that the vape can travel outwardly only via the through opening 20. In other words, the vaporizer assembly should form a sealed/airtight connection with the through opening 20 in the mouthpiece 14.

As illustrated in FIG. 4, the body of the mouthpiece 14 may by symmetrical and may have a substantially S-shaped profile in front view (i.e., a substantially S-shaped profile to the left side of it, as more clearly illustrated in FIG. 4, and a mirrored S-shaped profile to the right side thereof in front view, as more clearly illustrated in FIG. 4). In other words, the mouthpiece 14 may have a compound shape defined by a substantially elliptical first end 16, a substantially elliptical second end 18 (which is greater in size than the end 16), and a body with an S-like and a mirrored S-like profile extending between the first and second ends 16 and 18.

As illustrated in FIGS. 3-4, the through opening 20 may have the same length L as the body of the mouthpiece 14. The through opening 20 may have a variable width W (see FIGS. 3-4) and a constant width W' (see FIG. 5) that is perpendicular to the variable width W along the length L. For example, with reference to FIG. 4, a profile of the through opening 20 may be curved (i.e., the variable width W increases toward the first end 16 of the mouthpiece 14).

However, the present invention is not limited to the curved profile of the through opening 20 illustrated in FIG. 4. For example, the through opening 20 may have other shapes that cause the width W thereof to increase in a direction toward the first end 16 (when starting off from the second end 18). For example, the through opening 20 may also have a V-like profile (as would otherwise be seen in FIG. 4 with the bottom of the V being open, of course, at the end 18 of the mouthpiece 14 and the top of the V corresponding to the first end 16). In this case, the profile of the through opening 20 would have a V-like shape.

This configuration is advantageous because the larger size of the opening 20 near first end 16 (which a user may bite since the end 16 is intended to be inserted in the oral cavity of the user) enables vape to flow through the opening 20 without a significant restriction even when the user bites the mouthpiece 14 (the biting action may reduce the cross-sectional area of the opening 20). In other words, the widening of the through opening 20 near first end 16 may compensate for a reduction in cross-sectional area that results in the opening 20 due to the biting action of a user, thereby still enabling vape to pass through the opening 20 when a user simultaneously bites and suctions on the mouthpiece 14.

The width W' may vary depending on the size of the mouthpiece 14. Merely as an example, in an embodiment, the width W' may be about 1 mm, and the width W may be about 1.5 mm at the first end 16.

Referring to FIG. 4, a dimension N, which indicates approximately the expected depth of insertion of the mouthpiece 14 into a user's mouth (relative to the end 16 thereof), is about 7.5 mm in an embodiment. In this embodiment, the width of the mouthpiece 14 at depth N is marked by the letter M in FIG. 4, and the dimension M is about 16 mm. In this embodiment, with reference to FIG. 4, a width K at the end 18 of the mouthpiece 14 is about 37 mm. It is understood that the mouthpiece 14 is not limited to the dimensions above.

The surface of the body of the mouthpiece 14 can have different finishes. For example, the outer surface of the body of the mouthpiece 14 can have a matte finish or a smooth finish as desired based on user preference.

Therefore, the vaping device 10 of the present invention is desirable because it is safe to use, it can provide users with a desired mouthfeel and can have a long usable life.

The vaping device 10 may be embodied as a non-user serviceable/refillable apparatus (e.g., a single use device). In this embodiment, when the vaping liquid inside of the device 10 is depleted, the device 10 may be discarded. That being said, the non-user serviceable vaping device 10 may be provided with a rechargeable battery and a charging port (e.g., a USB port) in order to ensure that a user can continue to operate it in case the battery becomes discharged before the vaping liquid is depleted inside the storage tank. In the non-user serviceable embodiment, the mouthpiece 14 can be permanently or removably connected to the body portion 12.

In addition, the mouthpiece 14 can be adapted for use with user-serviceable/refillable vaping devices. For example, in user-serviceable vaping devices, the mouthpiece 14 may be configured to be removably mounted to the body of the vaping device in order to provide access to the interior of the device when a user wishes to refill the storage tank, change the battery, etc.

As illustrated in the drawings, the body portion 12 of the vaping device 10 may have a generally elliptical cylinder shape. The length of the body portion 12 is denoted by the letter J in FIG. 2, and the length J, in an embodiment, is about 82.5 mm. In this embodiment, the width of the elliptical body portion 12 along its major axis is denoted by the letter K in FIG. 2, and dimension K is about 37 mm. It is understood that these dimensions are non-limiting.

While the present invention has been particularly shown and described with reference to exemplary embodiments thereof, it will be apparent to those of ordinary skill in the art that various changes in form and detail may be made therein without departing from the spirit and scope of the present invention.

What is claimed is:

1. A vaporizing device, comprising:

a body portion having an elliptical shape; and a mouthpiece, which is entirely comprised of an elastomeric material, having a substantially elliptical first end and a substantially elliptical second end delimiting a length of the mouthpiece, and a through opening extending along the length of the mouthpiece, between the first end and the second end, the through opening having a width that increases along the length of the mouthpiece in a direction toward the first end of the mouthpiece, the second end of the mouthpiece having a diameter that is greater than a diameter of the first end of the mouthpiece such that the mouthpiece is narrower at the first end than the second end, the second end of the mouthpiece being fixedly attached to the body portion such that the body portion and the mouthpiece form a sealed and airtight connection therebetween, wherein the mouthpiece has a hardness of about 40 Shore.

2. The vaporizing device of claim 1, wherein the mouthpiece comprises 15-35% silicon dioxide by weight, 5-10% silicone oil by weight and 60-80% methyl vinyl silicone rubber by weight.

3. The vaporizing device of claim 1, wherein the mouthpiece has a tensile failure stress point that ranges from about 0 to about 90 Shore.

4. The vaporizing device of claim 1, wherein the mouthpiece has a compressive failure stress point of about 20 MPa.

5. The vaporizing device of claim 1, wherein the mouthpiece further includes a body with an S-like and a mirrored S-like profile extending between the first and second ends thereof.

6. The vaporizing device of claim 1, wherein the through opening of the mouthpiece has a curved profile between the first and second ends of the mouthpiece.

7. The vaporizing device of claim 1, wherein the through opening of the mouthpiece has a V-shaped profile between the first and second ends of the mouthpiece.

8. A vaporizing device, comprising:

a body portion having an elliptical base and an elliptical sidewall extending from the base;

a flexible mouthpiece having a substantially elliptical first end and a substantially elliptical second end delimiting a length of the mouthpiece and a through opening extending along the length of the mouthpiece, between the first end and the second end, that has a width that increases along the length of the mouthpiece in a direction toward the first end of the mouthpiece, the second end of the mouthpiece having a diameter that is greater than a diameter of the first end of the mouthpiece such that the mouthpiece is narrower at the first end than the second end, the second end of the mouthpiece being fixedly attached to the body portion such that the body portion and the mouthpiece form a sealed and airtight connection therebetween, the mouthpiece including 5-10% silicone oil by weight and a hardness of an entirety of the mouthpiece of about 40 Shore.

9. The vaporizing device of claim 8, the mouthpiece further including 15-35% silicon dioxide by weight.

10. The vaporizing device of claim 9, the mouthpiece further including 60-80% methyl vinyl silicone rubber by weight.

* * * * *